US008657151B2

(12) United States Patent
Balkin et al.

(10) Patent No.: US 8,657,151 B2
(45) Date of Patent: Feb. 25, 2014

(54) HAND PROTECTION BARRIER DISPENSER

(76) Inventors: Kenneth R. Balkin, Madison, WI (US); Catherine C. Tollefson, Madison, WI (US); Judith L. Balkin, Madison, WI (US)

( * ) Notice: Subject to any disclaimer, the term of this patent is extended or adjusted under 35 U.S.C. 154(b) by 31 days.

(21) Appl. No.: 13/526,892

(22) Filed: Jun. 19, 2012

(65) Prior Publication Data

US 2012/0259455 A1 Oct. 11, 2012

Related U.S. Application Data

(63) Continuation-in-part of application No. 13/415,017, filed on Mar. 8, 2012, which is a continuation-in-part of application No. 12/365,068, filed on Feb. 3, 2009, now Pat. No. 8,146,776.

(60) Provisional application No. 61/027,008, filed on Feb. 7, 2008.

(51) Int. Cl.
*B65H 3/58* (2006.01)

(52) U.S. Cl.
USPC ..... 221/26; 221/212; 221/277; 2/159; 2/161.7; 223/111

(58) Field of Classification Search
USPC ..... 221/1, 45, 26, 212, 277; 2/159, 161.7; 223/111
See application file for complete search history.

(56) References Cited

U.S. PATENT DOCUMENTS

| | | | | |
|---|---|---|---|---|
| 2,592,786 | A | | 4/1952 | Birr |
| 3,408,125 | A | | 10/1968 | Rasmussen |
| 3,647,159 | A | | 3/1972 | Bump |
| 4,046,508 | A | | 9/1977 | McDonald |
| 4,131,044 | A | | 12/1978 | Cassia |
| 4,155,494 | A | * | 5/1979 | Poncy et al. ..... 223/111 |
| 4,165,138 | A | | 8/1979 | Hedge et al. |
| 4,644,689 | A | | 2/1987 | Arians |
| 4,658,469 | A | | 4/1987 | Hawkins |
| 4,773,532 | A | | 9/1988 | Stephenson |
| 4,832,942 | A | | 5/1989 | Crace |
| 4,898,309 | A | * | 2/1990 | Fischer ..... 223/111 |
| 4,997,139 | A | | 3/1991 | Menard |
| 5,314,668 | A | | 5/1994 | Biermaier |
| 5,577,635 | A | | 11/1996 | Block |
| 5,878,909 | A | | 3/1999 | Rogow |

(Continued)

FOREIGN PATENT DOCUMENTS

KR 950002326 3/1995

OTHER PUBLICATIONS

Dougherty, Conor, "Restroom Decor: Germy Doorknobs Inspire Inventors" Wall Street Journal, Feb. 15, 2008.

(Continued)

*Primary Examiner* — Patrick Mackey

(74) *Attorney, Agent, or Firm* — Reinhart Boerner Van Deuren s.c.

(57) ABSTRACT

A hand protection barrier dispenser for dispensing disposable sanitary barriers for temporarily covering the hand and providing complete hand protection is disclosed which dispenses the hand protection barriers in a manner so that they may easily be donned by a user thereof. The hand protection barrier operates to open each of the hand protection barriers into a position to be readily donned and dispensed. The hand protection barrier dispenser dispenses only a single hand protection barrier at a time.

23 Claims, 13 Drawing Sheets

(56) References Cited

U.S. PATENT DOCUMENTS

| | | | | |
|---|---|---|---|---|
| 5,882,667 | A | 3/1999 | Jones | |
| 5,921,434 | A | 7/1999 | Hollander et al. | |
| 5,987,645 | A | 11/1999 | Teaster | |
| 6,053,380 | A * | 4/2000 | Sherrod | 223/111 |
| 6,189,183 | B1 | 2/2001 | Hartselle, III | |
| 6,358,519 | B1 | 3/2002 | Waterman | |
| 6,375,034 | B1 | 4/2002 | Corbett | |
| 6,546,594 | B1 | 4/2003 | Wills | |
| 6,645,435 | B2 | 11/2003 | Dawson et al. | |
| 6,789,695 | B1 | 9/2004 | Gaudreau | |
| 6,837,708 | B2 * | 1/2005 | Chen et al. | 433/80 |
| 6,874,697 | B2 | 4/2005 | Callueng | |
| 6,912,728 | B2 | 7/2005 | Panella | |
| 6,925,763 | B2 | 8/2005 | Stark et al. | |
| 6,932,253 | B2 * | 8/2005 | Sato | 223/111 |
| 7,043,800 | B2 | 5/2006 | Moody | |
| 7,080,427 | B1 | 7/2006 | Campopiano et al. | |
| 7,175,807 | B1 | 2/2007 | Jones | |
| 7,246,382 | B2 * | 7/2007 | Plut et al. | 2/161.6 |
| D551,476 | S | 9/2007 | Cittadino et al. | |
| 7,320,418 | B2 | 1/2008 | Sassoon | |
| 8,146,776 | B2 | 4/2012 | Balkin et al. | |
| 2006/0010563 | A1 | 1/2006 | Michel et al. | |
| 2007/0170213 | A1 | 7/2007 | Gaines et al. | |
| 2008/0073388 | A1 * | 3/2008 | Saegusa | 223/111 |
| 2009/0200329 | A1 | 8/2009 | Balkin et al. | |
| 2011/0186589 | A1 | 8/2011 | Lee | |

OTHER PUBLICATIONS

Georgia-Pacific Away from Home-Safe-T-Guard Door Tissue & Dispensers, Internat listing, Feb. 15, 2008.

* cited by examiner

HAND PROTECTION BARRIER DISPENSER

CROSS-REFERENCE TO RELATED APPLICATION

This patent application is a continuation-in-part of U.S. patent application Ser. No. 13/415,017, filed on Mar. 8, 2012, entitled "Hand Protection Barrier Dispenser," which in turn is a continuation-in-part of U.S. patent application Ser. No. 12/365,068, filed on Feb. 3, 2009, now U.S. Pat. No. 8,146,776, granted on Apr. 3, 2012, entitled "Hand Protection Barrier Dispenser," which patent application claims priority of U.S. Provisional Patent Application No. 61/027,008, which is entitled "Hand Protection Barriers and Dispenser Therefor," and which was filed on Feb. 7, 2008, all three of which patent applications are hereby incorporated herein by reference in their entirety.

BACKGROUND OF THE INVENTION

Field of the Invention

The present invention pertains generally to disposable sanitary barriers for temporarily covering the hand, and more particularly to a hand protection barrier dispenser for dispensing such barriers.

People today are becoming increasingly mindful of the sanitary conditions of public facilities such as public restrooms. While most people wash their hands after using such facilities, it is common knowledge that many people do not do so. This fact has been established by a number of studies that show that as many as thirty to forty percent of people using a restroom do not wash their hands prior to leaving the restroom. In addition, such studies have also shown that those individuals that do wash their hands, only about half use soap.

Thus, harmful bacteria may often be present on the hands of public restroom users, and such harmful bacteria can be and are left behind on the restroom door handle by such users as they are exiting the restroom. Bacteria can survive sufficiently long to be passed on to subsequent restroom users even though they have washed their hands by touching the door handle as they leave the restroom. Most public restroom users would be happier with the knowledge that they can leave a restroom without picking up bacteria from previous users unwashed hands that may have been left on the restroom door handle.

For years, public restroom users have been improvising ways to exit a public restroom without touching the door handle with their bare hands. For example, such users may use a paper towel or other material to form a barrier with which to grasp the restroom door handle as they exit the restroom. However, paper towels and the like are not necessarily available in all restrooms at all times, and often there is no convenient place near the door for the restroom user to dispose of the used paper towel. Also, the porous material of a paper towel may not provide restroom users with a high degree of confidence that a protective barrier is being provided between their hand and the restroom door handle, especially if their hand and/or the door handle is even slightly wet.

As might be expected, various potential solutions to this problem have been attempted in the past. One such potential solution over this improvised method is described, for example, in U.S. Pat. No. 6,925,763, to Stark et al. The Stark et al. patent provides a tissue dispenser and separate tissue receptacle that are both mounted on or near the door handle of a restroom door. Upon exiting the restroom, a restroom user may easily grasp a tissue from the tissue dispenser, use it to open the restroom door, and dispose of the tissue in the tissue receptacle. Of course, the sheets of tissue used in the Stark et al. patent do not provide a complete hand protection barrier.

At best, such a tissue sheet only provides a barrier for the front surface of the restroom user's hand. To provide even this protection, the restroom user must take a sheet of tissue from the dispenser and manipulate it to a position that covers the restroom user's hand so that no part of the restroom user's hand touches the restroom door handle. Many restroom users using the sheet of tissue do not take the time or care to properly position the tissue to provide an effective protective barrier.

A more complex potential solution to this problem is described in U.S. Pat. No. 4,997,139, to Menard. The Menard patent provides a mechanical dispensing device that automatically dispenses a continuous sanitary covering for a restroom exit door handle. After each use of the door, the mechanical devise advances the sanitary covering to provide a new sanitary covering surface for the door handle. Although this solution may be effective, it is also much more mechanically complex and expensive to implement and is also at least potentially subject to mechanical failure.

Still another potential solution to this problem is described in U.S. Pat. No. 6,912,728, to Panella. The Panella patent provides a hygienic pocket of material that may be placed on a restroom user's hand, and has an adhesive used to temporarily retain the hygienic pocket of material on the restroom user's hand while the door handle of a restroom door is being grasped. The hygienic pockets of material are dispensed from a dispenser that is only minimally disclosed. The hygienic pocket of material consists of two sheets retained together to define the pocket, with the sheet having the adhesive thereupon being longer than the other sheet. Dispensing such hygienic pockets of material that each include adhesive does not appear to be addressed by the Panella patent.

An improvement to these devices is shown in U.S. Pat. No. 8,146,776, to Balkin et al., which was invented by the inventors of the present patent application and which is the above-incorporated by reference grandparent of the present patent application. The device of the Balkin et al. '776 Patent dispenses hand protection barriers from a roll of such hand protection barriers each having an opening therein and each connected to a subsequent hand protection barrier by a perforated connection. The dispensing mechanism dispenses the hand protection barriers through an opening in its housing, and opens each of the hand protection barriers as it is moved into position to be accessed through the opening in the housing. While this dispenser represented a substantial improved over the other devices referenced above, its mechanism is somewhat complex, making the device more expensive to manufacture and buy than is desired.

A further improvement to these devices is shown in U.S. patent application Ser. No. 13,415,017, filed on Mar. 8, 2012, which was also invented by the inventors of the present patent application and which is the above-incorporated by reference parent of the present patent application. The device of the Balkin et al. '017 Application dispenses hand protection barriers from a stack of hand protection barriers each having an opening therein near a top end thereof. The dispensing mechanism dispenses the hand protection barriers selectively directs pressurized gas through one or more nozzles toward the opening in the top hand protection barriers in the stack to open it so that a user can insert his/her hand into it and pull it off of the stack, whereupon the next hand protection barrier in the stack may be opened. While this dispenser represented a very substantial improved over the other devices referenced above, it requires a canister of pressurized gas and a valving system to control the supply of pressurized gas to the nozzle (s).

It is desirable to provide an even simpler, inexpensive, and yet effective hand protection barrier dispenser for use by public restroom users and the like to dispense hand protection barriers.

The subject matter discussed in this background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

SUMMARY OF THE INVENTION

The present invention takes the form of a hand protection barrier dispenser for dispensing hand protection barriers which may be located at any convenient location. The hand protection barrier dispensed by the hand protection barrier dispenser of the present invention is made of a thin, impermeable material such as plastic that defines a hand protection barrier. The hand protection barriers may be defined by a segment of plastic film that is folded in half and sealed on its sides, thereby leaving a single opening. The hand protection barriers may be dispensed from a stack of hand protection barriers that are removably mounted on a hand protection barrier dispenser in a manner allowing a single hand protection barrier to be dispensed at a time.

Such hand protection barriers provide a user-friendly way for restroom users to exit a public restroom without directly contacting a potentially germ covered restroom door handle. The hand protection barrier dispenser that is used to dispense these hand protection barriers from the stack of hand protection barriers may be mounted on a door, such as a public restroom door, adjacent to the door handle or knob, or on an adjacent wall. The hand protection barrier dispenser could of course also be mounted in other convenient locations where the dispensing of hand protection barriers is desirable. Examples of such other locations include locations in grocery store produce, meat, and bakery departments, as well as at self-service gas stations.

The hand protection barriers are dispensed from the stack of hand protection barriers located on the hand protection barrier dispenser, which may be mounted on a door, a wall, or some other support. The stack of hand protection barriers are dispensed individually, with the top one of the hand protection barriers in the stack being automatically opened by the hand protection barrier dispenser for donning by a user. The exposed hand protection barrier is supported in a position allowing a user to easily access it by slipping the user's hand into it and pulling it from the hand protection barrier dispenser, which action also exposes the next hand protection barrier in the stack, which is then in position to be dispensed.

In a first embodiment, a hand protection barrier dispenser for dispensing hand protection barriers from a stack of hand protection barriers each having an opening therein near a top end thereof has a housing that includes a receptacle in which the stack of hand protection barriers may be mounted for dispensing; an electric blower located in the housing which electric blower has an exhaust opening from which the electric blower blows air when the electric blower is provided with electric power; a switching mechanism which is located in the housing and is connected to a source of electric power, the switching mechanism being configured to provide electric power to the electric blower when the switching mechanism is actuated and to not provide electric power to the electric blower when the switching mechanism is not actuated; and at least one nozzle operatively connected to the exhaust opening of the electric blower to receive air blown from the electric blower when the switching mechanism is actuated and to direct the blown air toward the opening in a top one of the hand protection barriers in the stack of hand protection barriers in a manner that opens the top hand protection barrier to facilitate a user inserting the user's hand through the opening in the top hand protection barrier to don the top hand protection barrier; wherein the top hand protection barrier donned by a user may be removed from the stack of hand protection barriers by pulling the top hand protection barrier in which the user's hand is located away from the remainder of the stack of hand protection barriers.

In another embodiment, the hand protection barrier dispenser for dispensing hand protection barriers from a stack of hand protection barriers each having an opening therein near a top end thereof has a housing including a receptacle in which the stack of hand protection barriers may be installed for dispensing, wherein the receptacle has first and second sides and first and second ends and wherein the stack of hand protection barriers is installed in the receptacle with the top ends of the hand protection barriers located adjacent the first end of the receptacle, and wherein the receptacle is arranged and configured to have a V shaped cross-section with the apex of the "V" extending in a direction essentially parallel to and midway between the first and second sides of the receptacle; an electric blower located in the housing which electric blower has an exhaust opening from which the electric blower blows air when the electric blower is provided with electric power; a switching mechanism which is located in the housing and is connected to a source of electric power, the switching mechanism being configured to provide electric power to the electric blower when the switching mechanism is actuated and to not provide electric power to the electric blower when the switching mechanism is not actuated; at least one nozzle operatively connected to the exhaust opening of the electric blower to receive air blown from the electric blower when the switching mechanism is actuated and to direct the blown air toward the opening in a top one of the hand protection barriers in the stack of hand protection barriers in a manner that opens the top hand protection barrier to facilitate a user inserting the user's hand through the opening in the top hand protection barrier to don the top hand protection barrier; a system sensor for detecting the proximity of a user's hand at a location adjacent to the opening of the top hand protection barrier in the stack of hand protection barriers; and an electronic system for operating the switching mechanism in response to a signal from the system sensor to provide electric power to the electric blower to blow air to the at least one nozzle to open the hand protection barrier; wherein the top hand protection barrier donned by a user may be removed from the stack of hand protection barriers by pulling the top hand protection barrier in which the user's hand is located away from the remainder of the stack of hand protection barriers.

In still another embodiment, a hand protection barrier dispenser for dispensing hand protection barriers from a stack of hand protection barriers each having an opening therein near a top end thereof has a housing including a receptacle in which the stack of hand protection barriers may be installed for dispensing; an electric blower located in the housing; a switching mechanism which is located in the housing and is connected to a source of electric power and provides electric power to the electric blower when the switching mechanism is actuated; and a nozzle operatively connected to the electric blower to receive air blown from the electric blower when the switching mechanism is actuated and direct it toward the opening in a top one of the hand protection barriers in the stack of hand protection barriers to open the top hand protection barrier; wherein the top hand protection barrier may be removed from the stack of hand protection barriers by pulling it away from the remainder of the stack of hand protection barriers.

In a method embodiment, hand protection barriers each having an opening therein near a top end thereof are dispensed from a stack of such hand protection barriers by installing the stack of hand protection barriers in a receptacle in the hand protection barrier dispenser; providing an electric blower located in the housing which has an exhaust opening from air is blown when the electric blower is provided with electric power; controlling the operation of the electric blower to blow air with a switching mechanism, the switching mechanism providing electric power to the electric blower when the switching mechanism is actuated and not provide electric power to the electric blower when the switching mechanism is not actuated; directing the air blown from the exhaust opening of the electric blower through at least one nozzle receiving air blown from the electric blower when the switching mechanism is actuated toward the opening in a top one of the hand protection barriers in the stack of hand protection barriers in a manner that opens the top hand protection barrier to facilitate a user inserting the user's hand through the opening in the top hand protection barrier to don the top hand protection barrier; and pulling the top hand protection barrier in which the user's hand is located away from the remainder of the stack of hand protection barriers to remove the hand protection barrier donned by the user from the stack of hand protection barriers.

It will thus be appreciated that the hand protection barrier dispenser of the present invention may be mounted on or near a restroom door such that it is in a convenient location to dispense hand protection barriers to restroom users as they are about to leave the restroom. Such a hand protective barrier dispenser may be used in other applications, such as in grocery stores in the produce, meat, and/or bakery departments, to protect users' hands from direct contact with meat, fruit, vegetables, and/or bakery products, thereby enabling purchasers to purchase uncontaminated food. The hand protection barrier dispenser of the present invention may also be used at self-service gas stations, to prevent gasoline, oil, or other substances from contacting the user's hands. Still another potential use of the hand protection barrier dispenser of the present invention is use in cleaning pet liter containers.

It may therefore be seen that the present invention teaches a simple, inexpensive, and yet effective hand protection barrier dispenser for use by public restroom users and the like to dispense hand protection barriers.

DESCRIPTION OF THE DRAWINGS

These and other advantages of the present invention are best understood with reference to the drawings, in which.

DETAILED DESCRIPTION OF THE EXEMPLARY EMBODIMENTS

Figure 1:
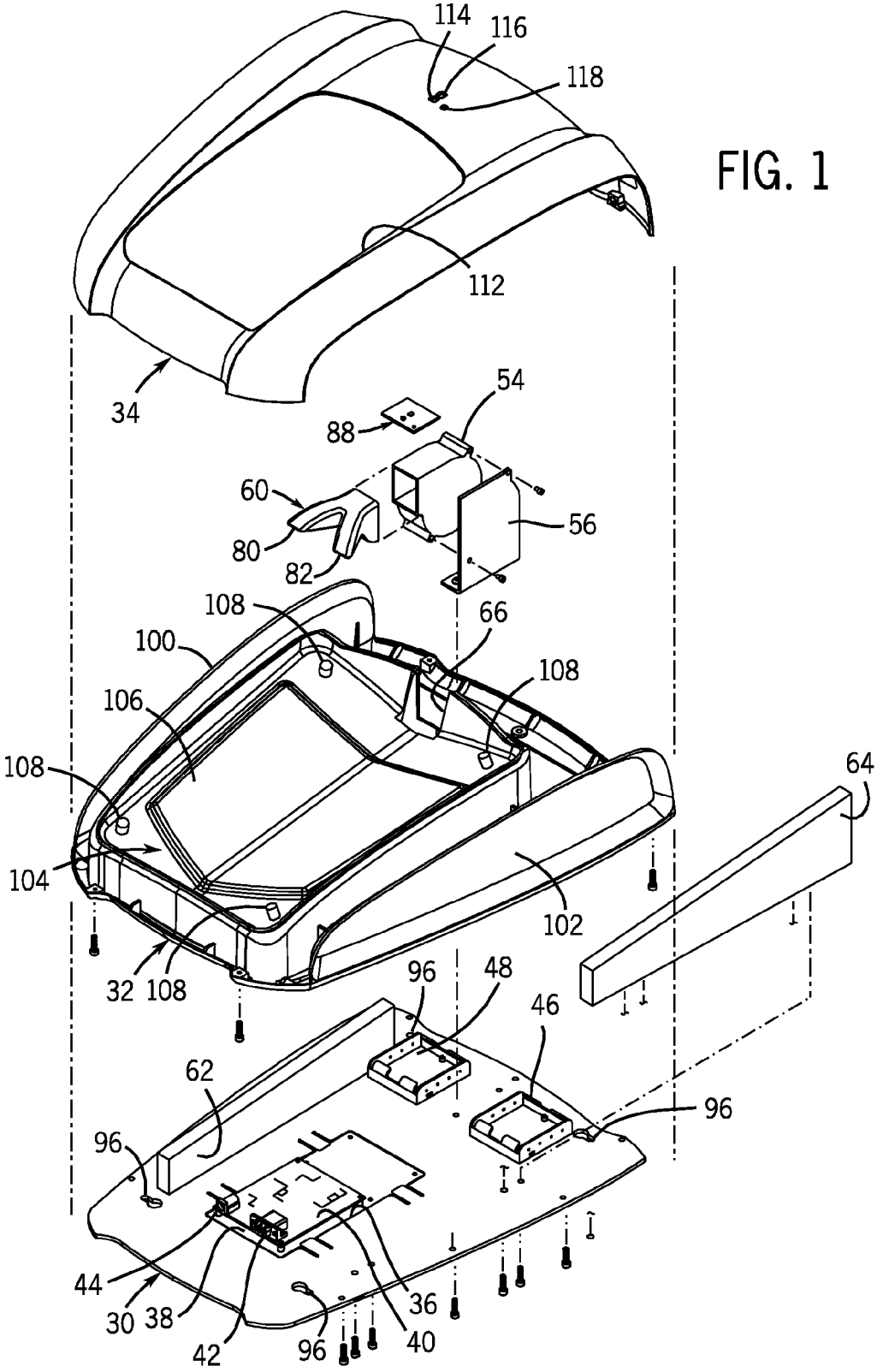
FIG. 1 is an isometric view of an exemplary hand protection barrier dispenser with the in accordance with the present invention showing the principal operating components mounted on a housing base with lower and upper housing members exploded away from the housing base for clarity.

An exemplary embodiment of the hand protection barrier dispenser of the present invention is illustrated in the figures and may be discussed in conjunction therewith. Referring first to FIG. 1, the three components of a housing of the hand protection barrier dispenser of the present invention are shown. A housing base 30 is a flat member onto which the various components of the hand protection barrier dispenser will be assembled. A lower housing member 32 which will be mounted onto the housing base 30 is shown exploded away from the housing base 30, and an upper housing member 34 which will be mounted onto the lower housing member 32 is shown exploded away from the lower housing member 32.

Figure 2:
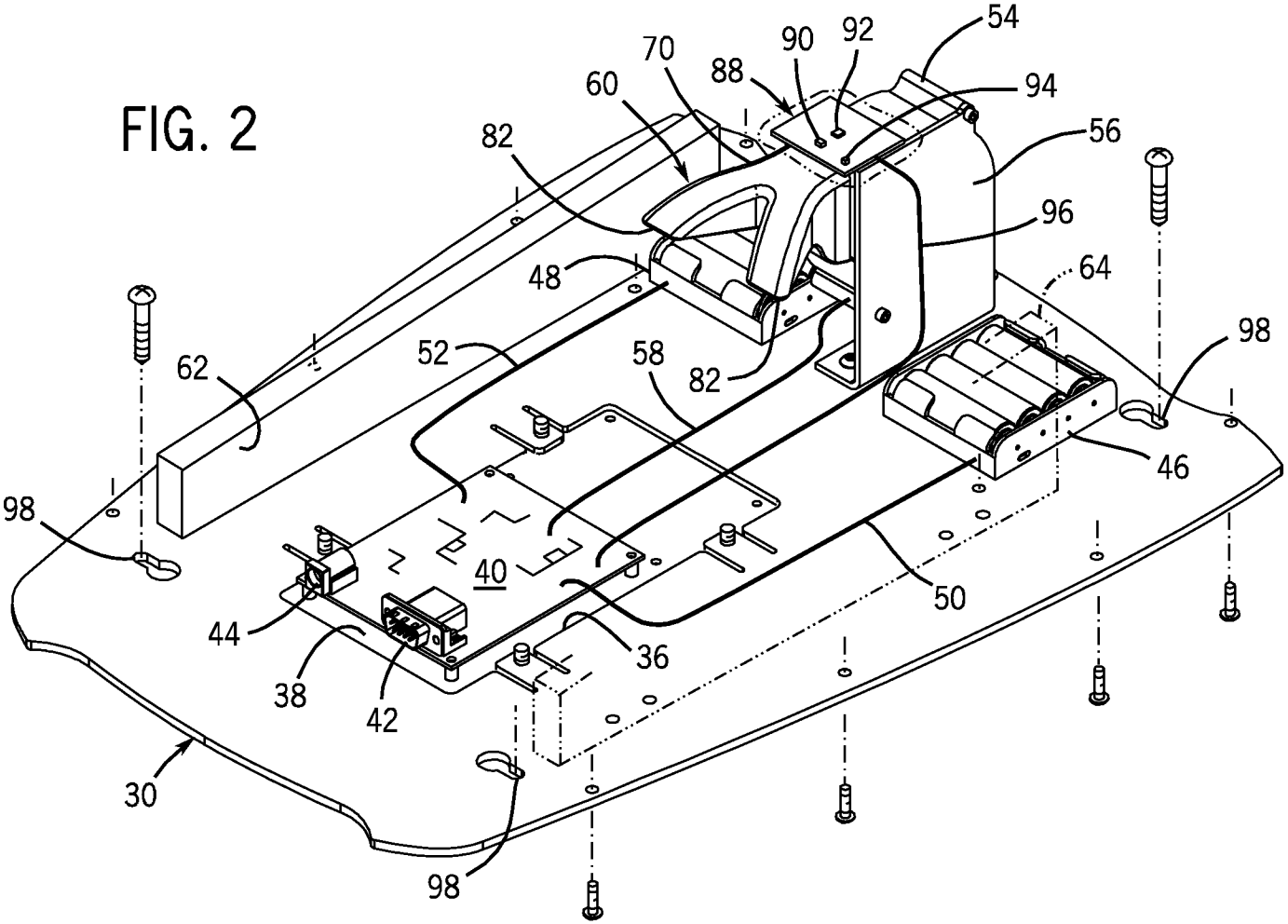
FIG. 2 is an isometric view of the hand protection barrier dispenser illustrated in FIG. 1 assembled with the upper and lower housing members removed to show the assembly of the various components mounted on a housing base.

Referring now to FIGS. 1 and 2, the housing base 30 may be made of a stamped segment of sheet metal, and contains a plurality of small apertures through which a plurality of screws may be passed to mount the various components of the hand protection barrier dispenser onto the housing base 30. The principal operating components of the hand protection barrier dispenser of the present invention are mounted onto the housing base 30. The housing base 30 has a rectangular aperture 36 located therein into which a removable bottom cover member 38 is shown as being installed (through the use of four screws). The bottom cover member 38 is removable from the housing base 30 to facilitate access to the interior of the hand protection barrier dispenser.

A system board 40 that contains most of the electronic circuitry that is used to operate the hand protection barrier dispenser is mounted (with four screws in an electrically isolated manner) onto the surface of the bottom cover member 38 that will be on the inside of the hand protection barrier dispenser when the bottom cover member 38 is installed into the rectangular aperture 36 of the housing base 30. The system board 40 optionally includes a communications connector 42 which may be used to connect the system board 40 to a computer (not shown) which may optionally be used to program the system board 40, which may be an off-the-shelf programmable board. The system board 40 optionally includes a power connector which may be used to power the system board 40 either during its programming or also optionally during the operation of the hand protection barrier dispenser of the present invention, although it will be appreciated by those skilled in the art that this may not be desirable since it would require supplying external power to the hand protection barrier dispenser, which would likely complicate its installation.

Two battery holders 46 and 48 that are preferably used to power the operation of the hand protection barrier dispenser are mounted (with four screws each) onto the surface of the bottom cover member 38 that will be on the inside of the hand protection barrier dispenser but accessible by removing the upper housing member 34. The battery holders 46 and 48 are respectively connected to supply power to the system board 40 with wires 50 and 52 (shown only in FIG. 2). The battery holders 46 and 48 may be any of a number of different types so long as the voltage output and the longevity of the power sources to be installed in the battery holders 46 and 48 are sufficient to power the operation of the hand protection barrier dispenser of the present invention for a sufficiently long duration (or a sufficient number of hand protection barriers to be dispensed). The battery holders 46 and 48 shown will each hold, for example, four AA-size alkaline or lithium batteries, which will dispense at least approximately 500 hand protection barriers from the hand protection barrier dispenser.

A compact electric-powered blower 54 is mounted intermediate the two battery holders 46 and 48 on the housing base 30 using a blower bracket 56. The blower bracket 56 is mounted onto the housing base 30 using a pair of screws, and the blower 54 is mounted onto the blower bracket 56 using a pair of screws. The blower 54 is selectively supplied with electric power from the system board 40 with wires 58 to cause the blower 54 to plow air from an outlet located near the top of the blower 54 and at the side facing toward the system board 40. An air duct assembly 60 is mounted onto the exhaust of the blower 54 to direct the air blown by the blower 54 when it is provided with electric power by the system board 40.

The blower 54 should operate on low voltage direct current, given that the power supply of the hand protection barrier dispenser is from batteries that will be installed in the battery holders 46 and 48. It should also provide an appropriately selected flow of air when it is powered. An example of an appropriate choice for the blower 54 is a Model PMB1275PNB1-AY DC brushless blower from Sunonwealth Electric Machine Industry Co., Ltd. of Kaohsiung, Taiwan, R.O.C., which operates on 12 Volts DC (6 13.8 Volts DC) and has a nominal air delivery rate of 13.6 CFM when operated at the rated speed.

A support bracket 62 is shown mounted onto the surface of the housing base 30 that will be on the inside of the hand protection barrier dispenser. A second support bracket 64 is shown exploded off of the housing base 30 on the same side thereof. The support brackets 62 and 64 are used to support portions of the lower housing member 32 above the housing base 30.

The air duct assembly 60 extends through an slot 66 located in the lower housing member 32 (which will be discussed more fully below in conjunction with the discussion of the lower housing member 32) which slot 66 is open at the top side of the lower housing member 32. The air duct assembly 60 has a hollow interior to convey air provided when the blower 54 is operated. The air duct assembly 60 shown herein has two nozzles 80 and 82 located on the front side of the air duct assembly 60 as it is shown in FIGS. 1 and 2, with the nozzles 80 and 82 being spaced slightly apart and directing air downwardly and away from the blower 54.

Optionally, the nozzles 82 and 84 may also be mounted in the air duct assembly 60 in an adjustable fashion thereby allowing them to be optimally directed. Also optionally, the nozzles 82 and 84 may each be flow controlled by using a valve or a flow-adjustable orifice to control the flow through each of them. While it would likely prove to be unduly complex, it would also be optionally possible to operate the nozzles 82 and 84 to move to accommodate a changing height of hand protection barriers located in the hand protection barrier dispenser. Additionally, more or less than two nozzles may be used with the air duct assembly 60 if desired.

The last of the primary operating components of the hand protection barrier dispenser of the present invention is a sensor board 88. The sensor board 88 will be mounted to the surface of the lower housing member 32 (shown in FIG. 1) in a position to be described below. The sensor board 88 has a signal source 90, a reflected signal sensor 92, and an indicator LED 94 mounted thereupon. The signal source 90 generates an optical or high frequency signal that may be reflected back onto the reflected signal sensor 92 by an object (such as the hand of a person) that is in sufficiently close proximity (i.e., within approximately six inches or less) to the signal source 90 and the reflected signal sensor 92 on the sensor board 88. (It should be noted that the positions of the signal source 90 and the reflected signal sensor 92 could be reversed or moved to a close adjacent position, so long as they are located near the position in which they are shown in FIG. 2, for reasons that will become apparent below in conjunction with the discussion of FIGS. 10 through 14.)

Thus, the signal source 90 may be, for example, an infrared LED or an ultrasonic signal generator, and the reflected signal sensor 92 may be, for example, a photodiode sensitive to infrared or an ultrasonic detector, respectively. The indicator LED 94 must be clearly visible to a person when illuminated. The sensor board 88 is electrically connected to the system board 40 with wires 96 (shown only in FIG. 2) used to allow the system board 40 to operate the sensor board 88 as well as to provide information from the sensor board 88 back to the system board 40.

The housing base 30 may also have a plurality of mounting holes 98 located therein (some of which are visible in FIGS. 1 and 2) for attaching the hand protection barrier dispenser to a surface on which it is to be mounted (not shown in FIG. 1 or 2).

Referring primarily to FIG. 1, the construction of the lower housing member 32 will now be described in greater detail. The lower housing member 32 has two opposite side members 100 and 102, with a recessed, rectangular barrier receptacle 104 located intermediate the side members 100 and 102 into which a stack of hand protection barriers (to be described below in conjunction with FIGS. 4 through 6) will be installed for dispensing therefrom. The barrier receptacle 104 is V-shaped in cross-section with the apex of the "V" extending in a direction essentially parallel to and midway between the side members 100 and 102. This "V" shape is important to ensure proper dispensing of hand protection barriers from the hand protection barrier dispenser, as will become evident below in conjunction with a discussion of FIGS. 8 and 9.

Located in the barrier receptacle 104 is a rectangular, V-shaped elevated floor 106 that extends substantially the entire width of the barrier receptacle 104, but which is spaced away from the end of the barrier receptacle 104 at which the slot 66 is located. This space is also important to ensure proper dispensing of hand protection barriers from the hand protection barrier dispenser, as will become evident below, as will also become evident below in conjunction with a discussion of FIGS. 8 and 9. Located in the barrier receptacle 104 near to the four corners thereof are four dispenser mounting pegs 108 which extend upwardly from the top surface of the barrier receptacle 104.

Located intermediate the side members 100 and 102 at the end opposite the location of the barrier receptacle 104 is large opening 110 through which batteries may be installed into the battery holders 46 and 48, as will become evident in conjunction with the discussion of FIG. 3 below. In order to install the lower housing member 32 onto the housing base 30, the air duct assembly 60 is located in the slot 66 in the lower housing member 32. The lower housing member 32 blower 54 and the blower bracket 56 are then lowered onto the housing base 30, and the blower bracket 56 is secured to the housing base 30 as described above, after which the lower housing member 32 may be secured on the housing base 30 with a plurality of screws.

Still referring primarily to FIG. 1, the construction of the upper housing member 34 will now be described in greater detail. The upper housing member 34 is configured to fit over the lower housing member 32 intermediate the side members 100 and 102 of the lower housing member 32, in a manner enclosing completely the large opening 110 in the lower housing member 32. The upper housing member 34 has a large opening 112 therein which surrounds the barrier receptacle 104 in the lower housing member 32, leaving the barrier receptacle 104 completely accessible through 112 in the upper housing member 34.

The upper housing member 34 has three apertures 114, 116, and 118 located therein which are respectively aligned with the signal source 90, the reflected signal sensor 92, and the indicator LED 94 of the sensor board 88 (shown in FIG. 2). The sensor board 88 will be mounted (using two small screws not shown) under the upper housing member 34, with the signal source 90 sending its signal through the aperture 114, the reflected signal passing through the aperture 116 to the reflected signal sensor 92, and the indicator LED 94 being visible through the aperture 118.

Figure 3:
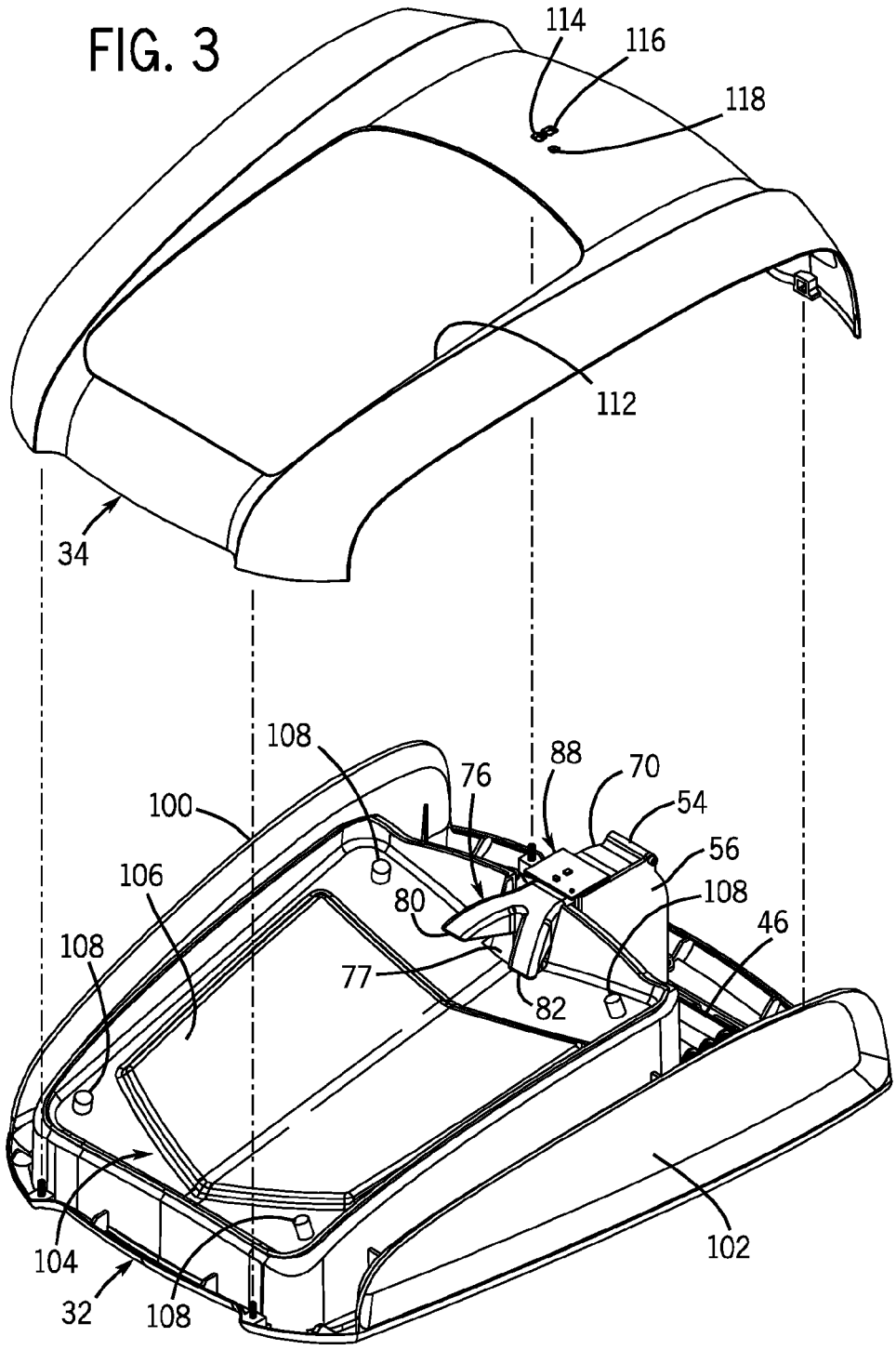
FIG. 3 is isometric view of the hand protection barrier dispenser illustrated in FIG. with the lower housing installed on the assembly illustrated in FIG. 2, and with the upper housing being installed onto the lower housing.

Referring now to FIG. 3, it will be appreciated that the upper housing member 34 is removable from the housing base 30 to facilitate access to the dispenser batteries (not shown) mounted in the battery holders 46 and 48 which may be used to power the hand protection barrier dispenser and other components of the hand protection barrier dispenser. The upper housing member 34 may be secured to the lower housing member 32 with a plurality of screws.

Figure 4:
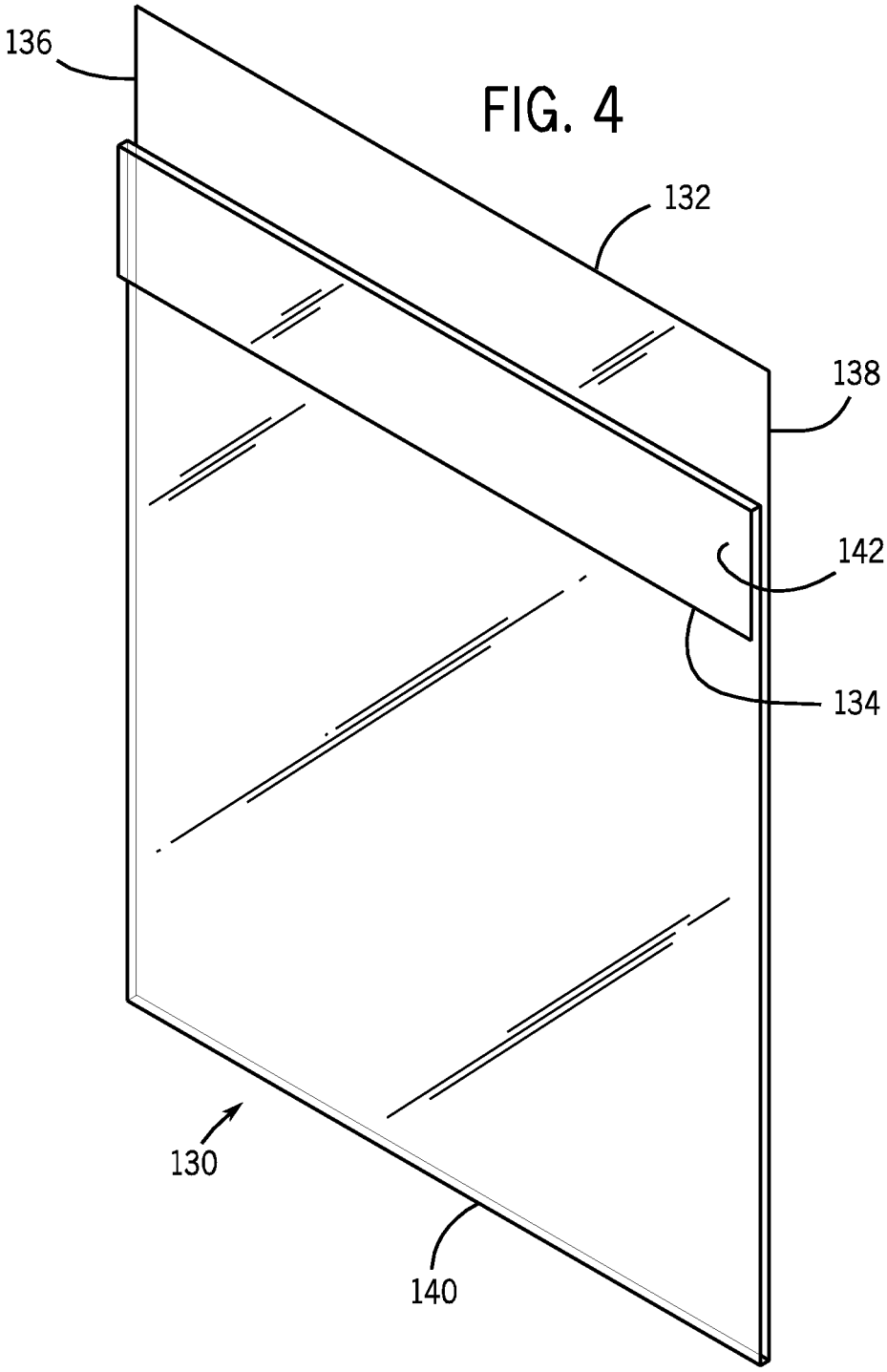
FIG. 4 is an isometric view showing the folding of a segment of thin film material which will be formed into a hand protection barrier.

Referring next to FIG. 4, a thin sheet of film material 130 having opposite ends 132 and 134 and opposite sides 136 and 138 which will be formed into a hand protection barrier is illustrated. The sheet of film material 130 is longer than it is wide, and it is folded in half lengthwise along a fold line indicated by the reference numeral 140, bringing the ends 132 and 134 together. The end 134 is then folded down as shown in FIG. 4, thereby making a cuff 142. This cuff 142 provides an additional degree of stiffness to this area of the sheet of film material 130 which will be of importance in the operation of the hand protection barrier dispenser of the present invention, as will become evident below.

By way of example, the sheet of film material 130 is preferably very thin, for example approximately 0.8 mil (0.0008 inches) thick, although its thickness may be varied substantially without departing from the principle of the present invention (for example, from 0.5 mils (0.0005 inches) to 3.0 mils (0.0030 inches)). It may be made of polyethylene film or any other suitable material, and preferably either are made of an anti-static material or have an anti-static substance applied thereto. A suitable type of antistatic material is polyethylene terephthalate ("PET"), which is a low-charging material (i.e. the material itself will not create a static charge). As an example of the size of the sheet of film material 130, it may be approximately twenty-one inches long and approximately seven and three-quarters inches wide, with folded-down size of the cuff 142 being approximately one and three-eighths inches.

Figure 5:
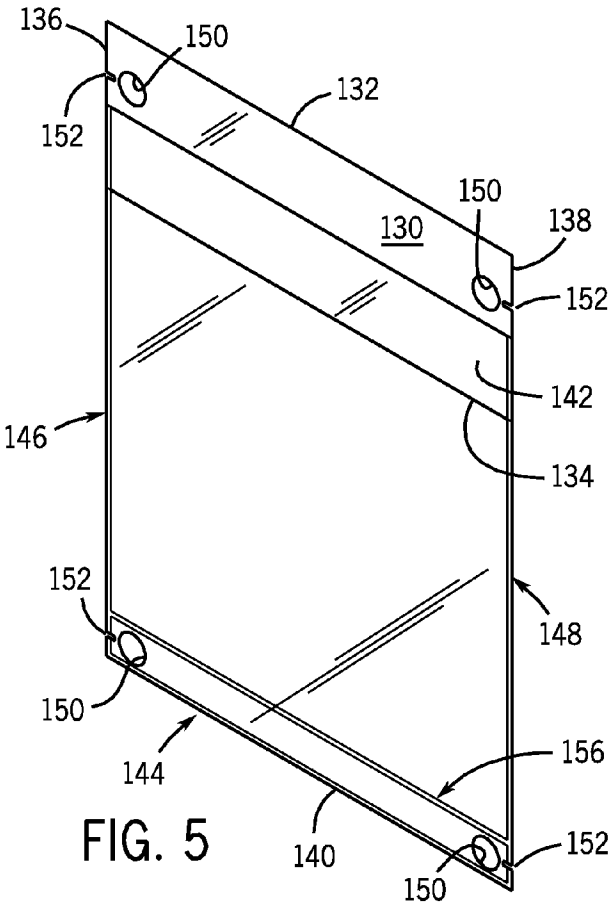
FIG. 5 is an isometric view of a finished hand protection barrier made from the folded segment of thin film material illustrated in FIG. 4 showing the hand protection barrier's sealed sides, the mounting apertures located therein, and the notches located therein adjacent each of the mounting apertures.

The completion of the manufacture of the sheet of film material 130 into a hand protection barrier 144 is shown in FIG. 5. The side 136 is sealed together as indicated by the reference numeral 146, and the side 138 is sealed together as indicated by the reference numeral 148. It will be appreciated that the sealed sides 146 and 148 will maintain the cuff 142 in place. Next, an aperture 150 is made in the hand protection barrier 144 adjacent each of its four corners (the apertures 150 may be a bit further from the end 132 than they are from the fold line 140). A notch 152 is placed into the side 136 or 138 adjacent to each of the apertures 150 to make it easier to tear the sheet of film material 130 between the sides 136 and 138 and the apertures 150.

The end 132 of the sheet of film material 130 defines a top end of each hand protection barrier 144 and the fold line 140 defines a bottom end of each hand protection barrier 144. A seal line 156 parallel to the fold line 140 is made in the hand protection barrier 144 on the sides of the two apertures 150 closest to the bottom of the hand protection barrier 144 on the sides of the apertures 150 opposite the fold line 140 to enclose the interior of the hand protection barrier 144 except at the location of the cuff 142.

Figure 6:
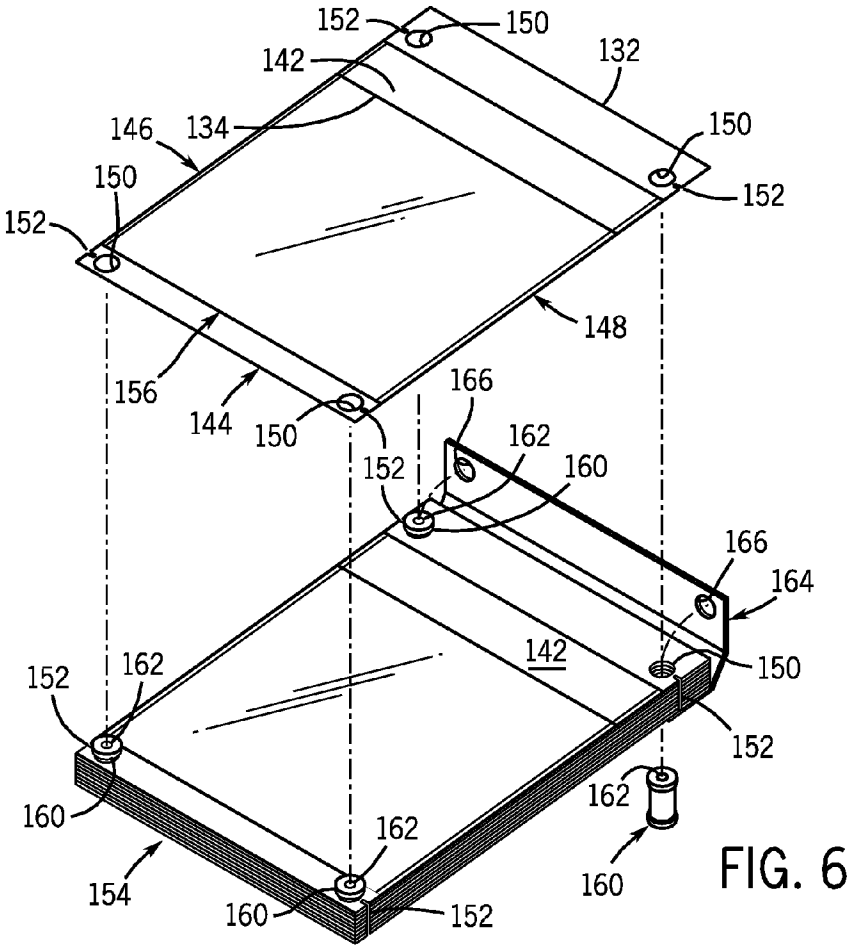
FIG. 6 is a partially exploded view showing the assembly of a stack of the hand protection barriers illustrated in FIG. 5 that is held together with mounting spools in each of the four mounting apertures.

The assembly of a plurality of the hand protection barriers 144 into a stack 154 of hand protection barriers 144 is illustrated in FIG. 6. Four spools 160 each having a diameter approximately the same as the diameters of the apertures 150 and flanges located at the top and bottom ends thereof that are sufficiently larger than the diameters of the apertures 150 are respectively inserted through the aligned the apertures 150 at the corners of the stacked hand protection barriers 144 to maintain them together. Note that the spools 160 have an aperture 162 therethrough that is designed to fit in an interference fit onto the dispenser mounting pegs 108 in the barrier receptacle 104 of the lower housing member 32 (shown in FIG. 1).

Located at the top end of the stack of hand protection barriers 144 is a collar 164 that is U-shaped in cross-section and encloses the top ends 132 of each of the hand protection barriers 144 in the stack 154 of hand protection barriers 144 therein. The collar 164 has four apertures 166 respectively located adjacent the four corners of the collar 164 that are the same size as the apertures 150 in the hand protection barriers 144. It may be seen from FIG. 6 that the two spools 160 located near the top of the stack 154 of hand protection barriers 144 each extend through two of the apertures 166 in the collar 164 as well as one of the apertures 150 in each of the hand protection barriers 144 in the stack 154 of hand protection barriers 144.

Optionally, the hand protection barriers 144 may have an attachment mechanism to each other to further facilitate the opening of the next subsequent hand protection barrier 144 when a hand protection barrier 144 is torn away from the stack 154 of hand protection barriers 144. Such an attachment point 168 may optionally be located at the midpoint of the cuff 142 of each hand protection barrier 144 which will provide a weak attachment to the hand protection barrier 144 located on top of it to help to open the hand protection barrier 144 when the previous hand protection barrier 144 is removed from the stack 154 of hand protection barriers 144. This attachment point 168 may, for example, consist of a small amount of a weak adhesive that will be sufficiently strong to open the hand protection barrier 144 when the previous hand protection barrier 144 is removed from the stack 154 of hand protection barriers 144, but not strong enough for the subsequent hand protection barrier 144 to be removed from the stack 154 of hand protection barriers 144.

Figure 7:
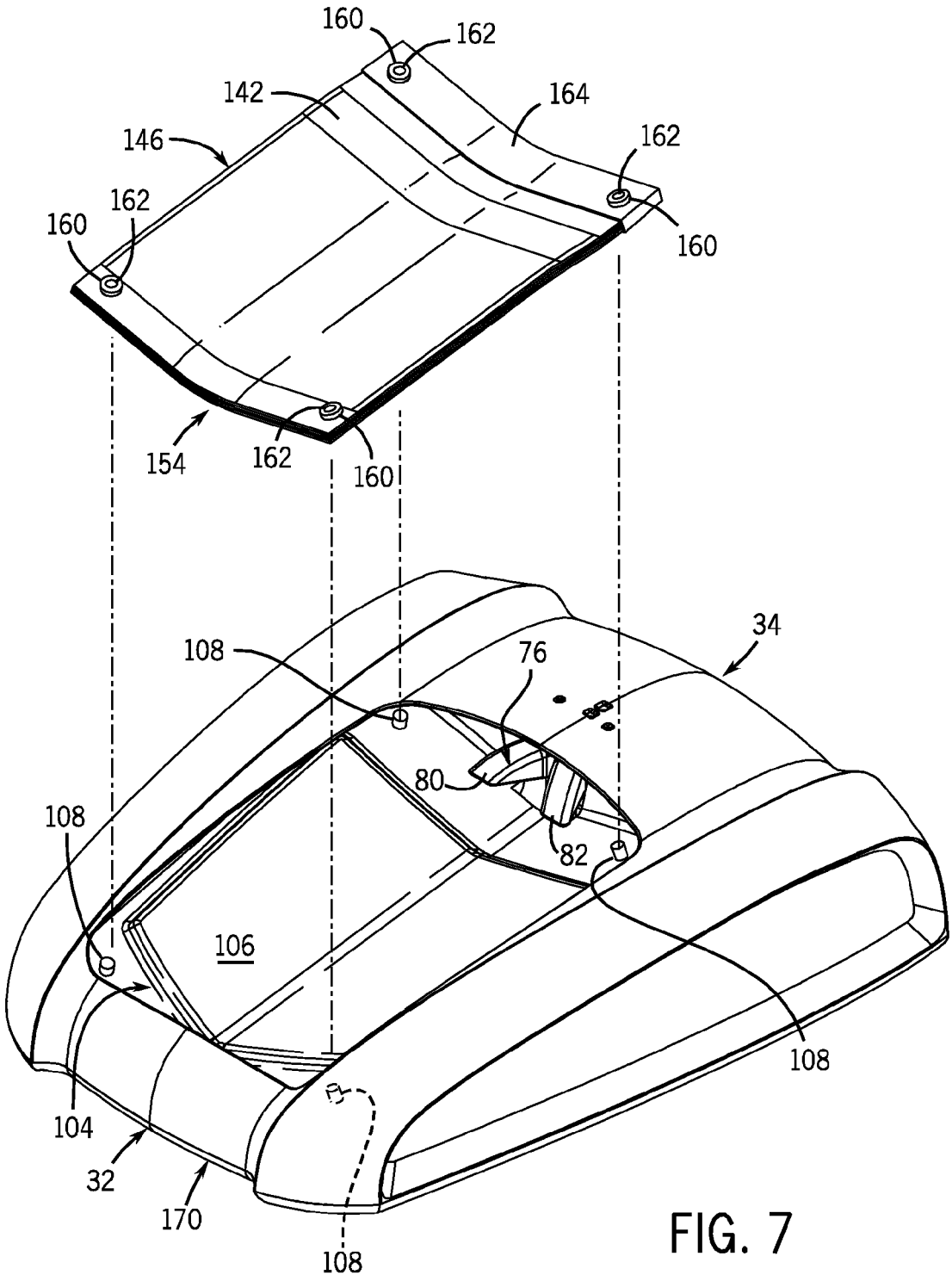
FIG. 7 is an isometric view of the stack of hand protection barriers illustrated in FIG. 6 being installed onto the hand protection barrier dispenser illustrated in FIG. 3.

Referring next to FIG. 7, the stack 154 of hand protection barriers 144 is shown as it is installed onto a fully assembled hand protection barrier dispenser 170. The stack 154 of hand protection barriers 144 is lowered into the barrier receptacle 104, with the bottom of the stack 154 of hand protection barriers 144 resting on the elevated floor 106 of the barrier receptacle 104. The four spools 160 in the stack 154 of hand protection barriers 144 are then lowered so that the apertures 162 in the spools 160 fully engage the dispenser mounting pegs 108 to retain the stack 154 of hand protection barriers 144 in the hand protection barrier dispenser 170.

Figure 8:
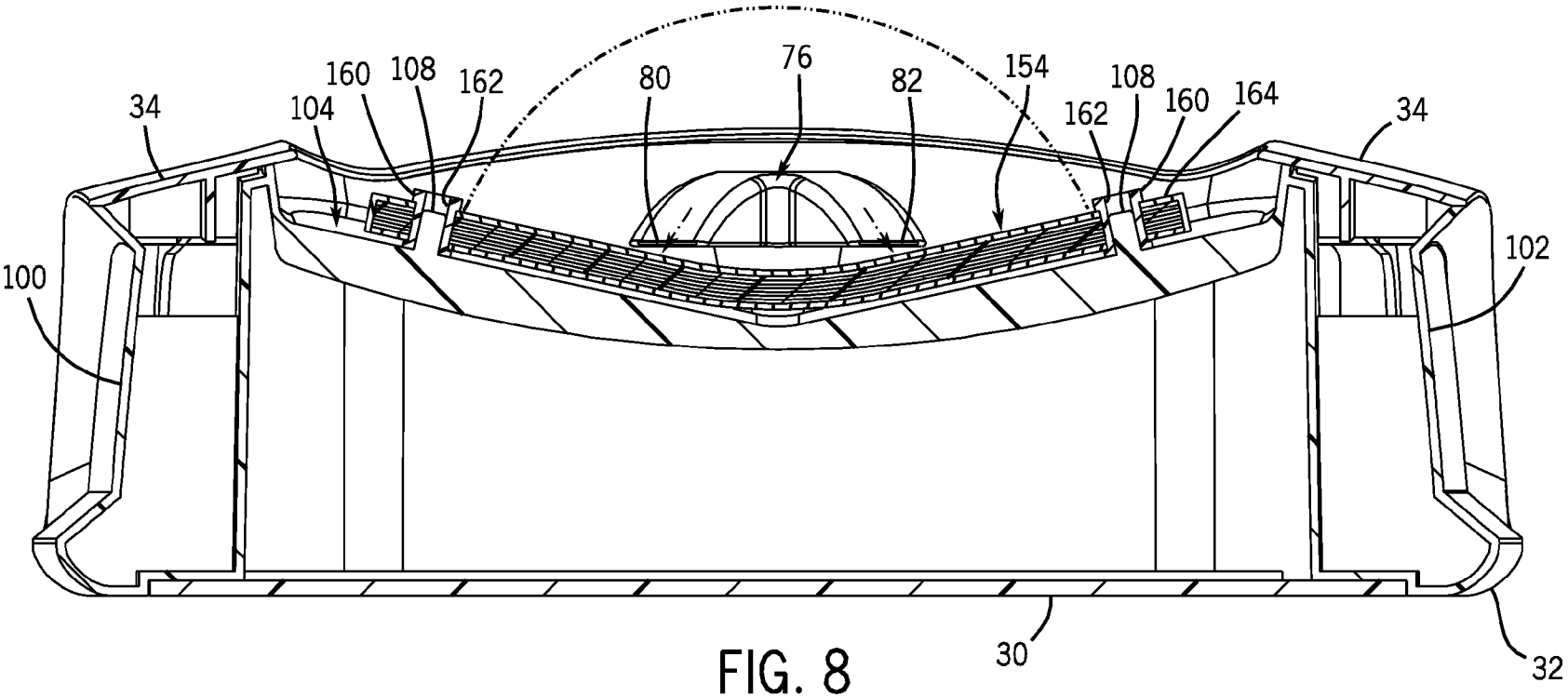
FIG. 8 is a first cross-sectional view of the hand protection barrier dispenser and the stack of hand protection barriers illustrated in FIG. 7, showing the V-shaped configuration of the stack of hand protection barriers on the upper housing.
Figure 9:
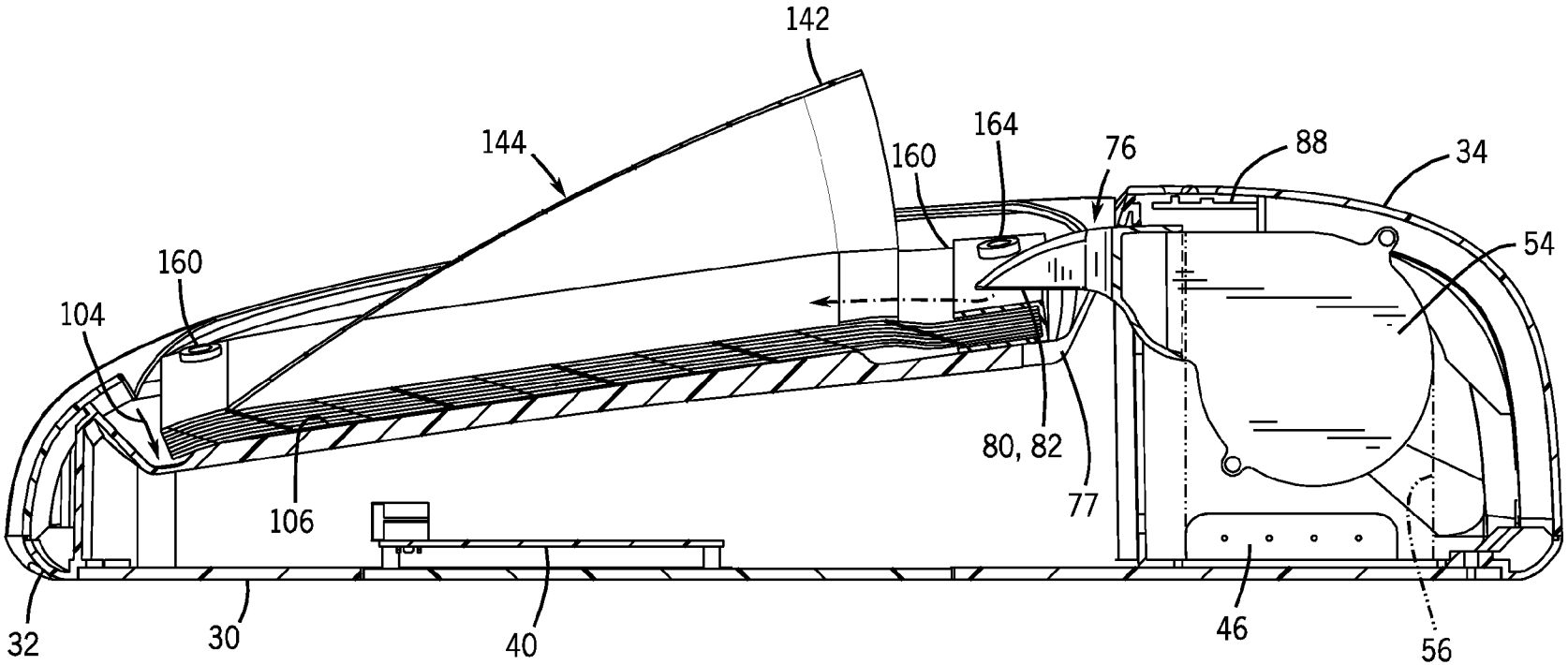
FIG. 9 is a second cross-sectional view of the hand protection barrier dispenser and the stack of hand protection barriers illustrated in FIG. 7, showing the manner in which the top hand protection barrier is opened by air pressure.

Referring now FIGS. 8 and 9 in addition to FIG. 7, the importance of the elevated floor 106 of the barrier receptacle 104, the V-shaped contour of the barrier receptacle 104 and the elevated floor 106 of the barrier receptacle 104, and the use of the cuff 142 on the hand protection barriers 144 may be fully appreciated. The attachment of the stack 154 of hand protection barriers 144 to the barrier receptacle 104 by mounting of the spools 160 onto the dispenser mounting pegs 108 maintains the stack 154 of hand protection barriers 144 in close contact with the barrier receptacle 104 and the raised surface 106.

It will be appreciated that the blower 54 blows air that is used to open each of the hand protection barriers 144. The air blown from the blower 54 is provided to the air duct assembly 60, and it is directed by the nozzles 80 and 82 toward the top portion of the hand protection barrier 144 on top of the stack 154 of hand protection barriers 144. It will cause the cuff 142 of that hand protection barrier 144 to be blown upward, opening the hand protection barrier 144. When the portion of that hand protection barrier 144 is blown upward, it may be seen from FIG. 8 that it will have an inverted U-shape that is located opposite the V-shape of the portion of that hand protection barrier 144 that remains in contact with the rest of the stack 154 of hand protection barriers 144.

With the particular blower 54 identified above, it has been determined that the blower 54 must be powered for approximately two seconds in order to inflate the hand protection barrier 144 on top of the stack 154 of hand protection barriers 144. With this particular blower 54, operation for two seconds will not bring it to its full speed, but operation for two seconds will be sufficient to inflate the top hand protection barrier 144. While the model of the blower 54 may vary, it will be appreciated that the duration of operation of the blower 54 may vary between approximately one second to approximately ten seconds. In addition, if desired the system board 40 may be configured to vary the duration of operation of the blower 54 depending upon the voltage of the batteries contained in the battery holders 46 and 48, increasing the duration of operation of the blower 54 as the battery voltage drops to compensate for the blower 54 accelerating slower or to a lower speed as a result of the lower battery voltage.

It may be noted from FIG. 9 that the top of the cuffs 142 of the hand protection barriers 144 are located at the right-most edge of the elevated floor 106 of the barrier receptacle 104. This ensures that the air blown from the blower 54 and provided to the air duct assembly 60 will consistently open the top hand protection barrier 144, which is already slightly open due to the location and the contour of the elevated floor 106. The V-shaped contour of the barrier receptacle 104 and the elevated floor 106 of the barrier receptacle 10, provide the same V-shaped contour to the stack 154 of hand protection barriers 144, meaning that once the air blown from the blower through the air duct assembly 60 has opened the topmost hand protection barrier 144, it will tend to stay in an open position rather than collapsing into a closed position. Additionally, once the hand protection barrier 144 has been opened, the cuff 142 provides additional stiffness and rigidity to also tend to assist it in staying in that position.

At this point, it is useful to describe a preferred mode of operation of the hand protection barrier dispenser of the present invention as that operation may be implemented by the electronic system contained in the system board 40. One possible operating mode of the hand protection barrier dispenser of the present invention would be to use the system sensor (the signal source 90 and the reflected signal sensor 92) to operate the blower 54 to provide air through the air duct assembly 60 to open a hand protection barrier 144 when a user's hand is in sufficiently close proximity to the hand protection barrier dispenser 170 to activate the system sensor, after which the user may insert his/her hand into the hand protection barrier 144 and tear it off of the rest of the stack 154 of hand protection barriers 144. However, this is not the preferred manner of dispensing the hand protection barriers 144.

Instead, the hand protection barrier dispenser of the present invention operated in a preferred mode wherein the top hand protection barrier 144 is open before the user approaches the hand protection barrier dispenser 170. This is done by using the system sensor (the signal source 90 and the reflected signal sensor 92) to sense when a user is about to insert his/her hand into the hand protection barrier 144. This initiates a timed period, which may be, for example from approximately three to twenty seconds (preferably approximately five seconds), during which it is assumed that the user has inserted his/her hand into the hand protection barrier 144 and torn it off of the rest of the stack 154 of hand protection barriers 144.

Upon the expiration of this timed period, the electronic system contained in the system board 40 will operate the blower 54 to provide air through the air duct assembly 60 to open the hand protection barrier 144 on top of the stack 154 of hand protection barriers 144. The raised surface 106 facilitates the air provided by the blower 54 and passing through the air duct assembly 60 to open the top hand protection barrier 144, and the V-shaped raised surface 106 and barrier receptacle 104 together with the cuff 142 on the hand protection barrier 144 ensure that once opened the hand protection barrier 144 will remain in its opened position. Optionally, if the hand protection barrier dispenser 170 is not used for a sufficiently long period of time, an additional operation of the blower 54 will provide air through the air duct assembly 60 to ensure that the hand protection barrier 144 is kept in its opened position.

Since a typical size of the stack 154 of hand protection barriers 144 has one hundred of the hand protection barriers 144, the electronic system contained in the system board 40 can also keep track of how many hand protection barriers 144 are remaining in the stack 154 of hand protection barriers 144. Each time the system sensor (the signal source 90 and the reflected signal sensor 92) senses when a user is about to insert his/her hand into the hand protection barrier 144, the electronic system will assume that a hand protection barrier 144 was dispensed and decrement the number of hand protection barriers 144 remaining in the stack 154 of hand protection barriers 144 by one. When a predetermined number of the hand protection barriers 144 are calculated to remain (e.g., five), the electronic system may begin to periodically flash the indicator LED 94 (shown in FIG. 2), which will be visible through the aperture 118 in the upper housing member 34 (shown in FIG. 1) to alert a facility operator that only the predetermined number of hand protection barriers 144 remain and a new stack 154 of hand protection barriers 144 must be installed soon.

Since the system board 40 may be programmed using the communications connector 42 (shown in FIG. 1), it will be appreciated that a number of variables may be set, preferably by using a computer connected to the communications connector 42 and running appropriate software. Alternately, instead of using the communications connector 42, a wireless connection (WI-FI or Bluetooth) could instead be used to allow the system board 40 to be programmed. Thus, it will be appreciated that the supply of air from the blower 54 through the air duct assembly 60 may be enabled by pulse duration, count, intervals, etc. Additionally, the timing of the warning indicator (the indicator LED 94) may also be configured. Since the system can run on batteries or use a low voltage power adapter connected to the power connector 44 (shown in FIG. 1), it will be appreciated that it can be installed anywhere and is quite safe as well.

Figure 10:
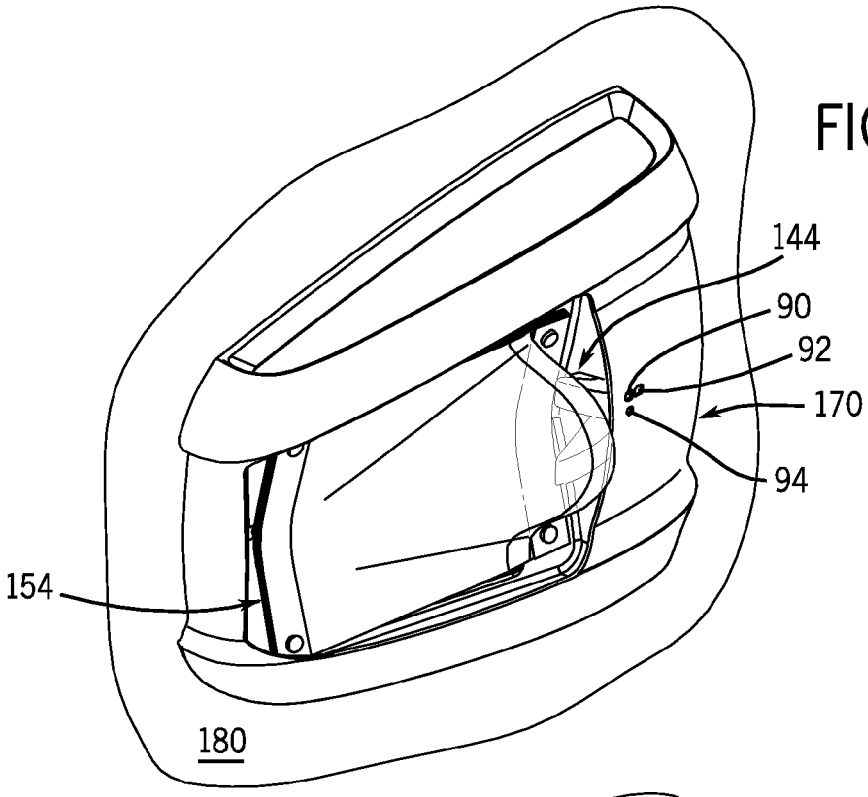
FIG. 10 is an isometric view of the hand protection barrier dispenser and the stack of hand protection barriers illustrated in FIG. 7 mounted on a surface, showing the top hand protection barrier shown in an open position on the hand protection barrier dispenser after it has been opened by air pressure so that it is ready to be dispensed.
Figure 11:
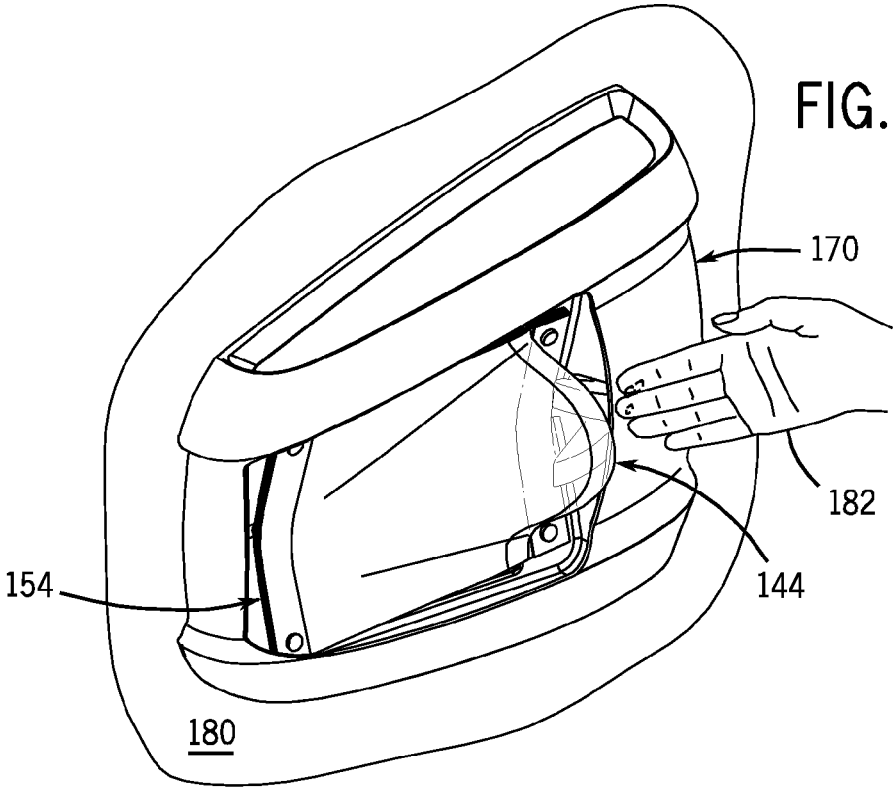
FIG. 11 is a an isometric view of the hand protection barrier dispenser illustrated in FIG. 10 showing a user's hand triggering the sensor and about to be inserted into the top hand protection barrier.

Referring now to FIG. 10, the hand protection barrier dispenser 170 is shown mounted upon a surface 180, with a hand protection barrier 144 in an opened configuration for dispensing. Referring next to FIG. 11, a user of the hand protection barrier dispenser 170 is shown beginning to insert his/her hand 182 into the open hand protection barrier 144, in the process placing his/her hand over the system sensor (the signal source 90 and the reflected signal sensor 92, which are shown in FIG. 10). This will initiate the timed period referenced above that is operated by the electronic system contained in the system board 40.

Figure 12:
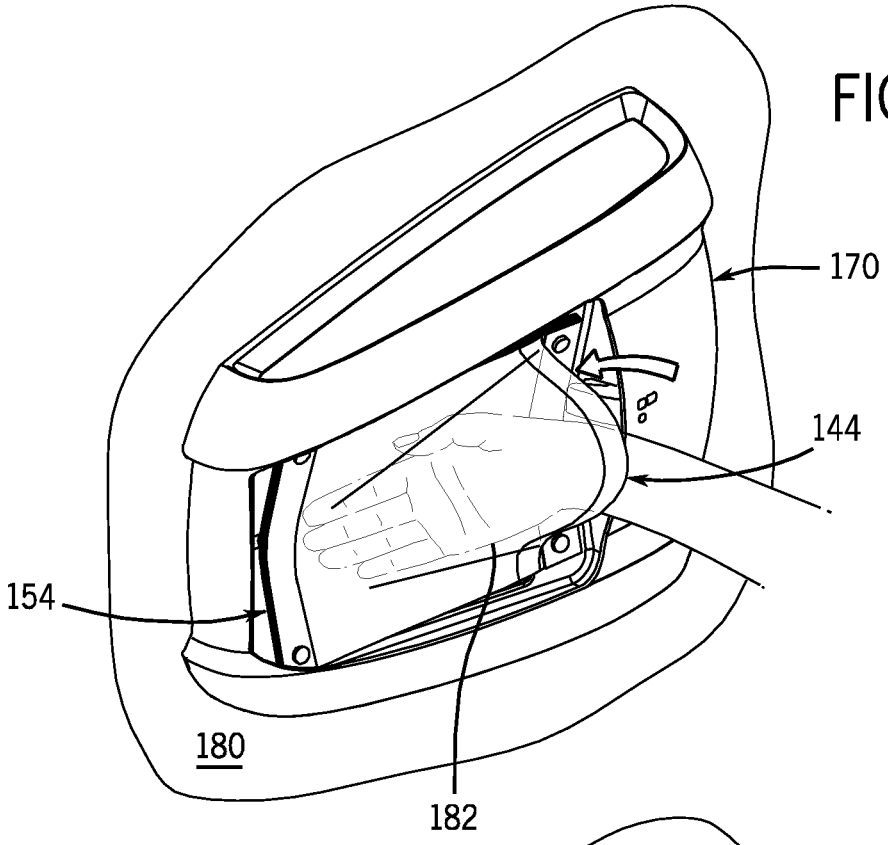
FIG. 12 is an isometric view of the hand protection barrier dispenser illustrated in FIG. 11 showing the user's hand fully inserted into the top hand protection barrier.
Figure 13:
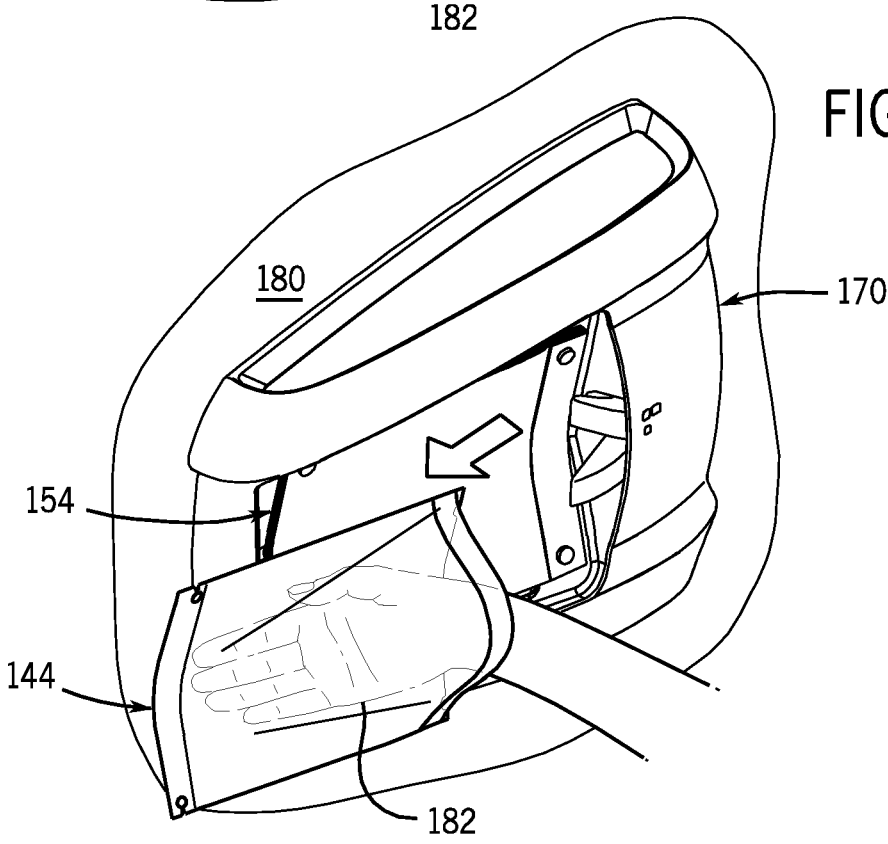
FIG. 13 is a plan view similar to the one illustrated in FIG. 12, showing the user's hand in the hand protection barrier having torn the top hand protection barrier from the stack of hand protection barriers.

In FIG. 12, the user's hand 182 is shown fully inserted into the open hand protection barrier 144, but without the open hand protection barrier 144 having been moved from the stack 154 of hand protection barriers 144. In FIG. 13, it may be seen that the user's hand 182 has pulled the open hand protection barrier 144 to the left and torn it off of the stack 154 of hand protection barriers 144, which exposes the next hand protection barrier 144, which at this point is unopened.

Figure 14:
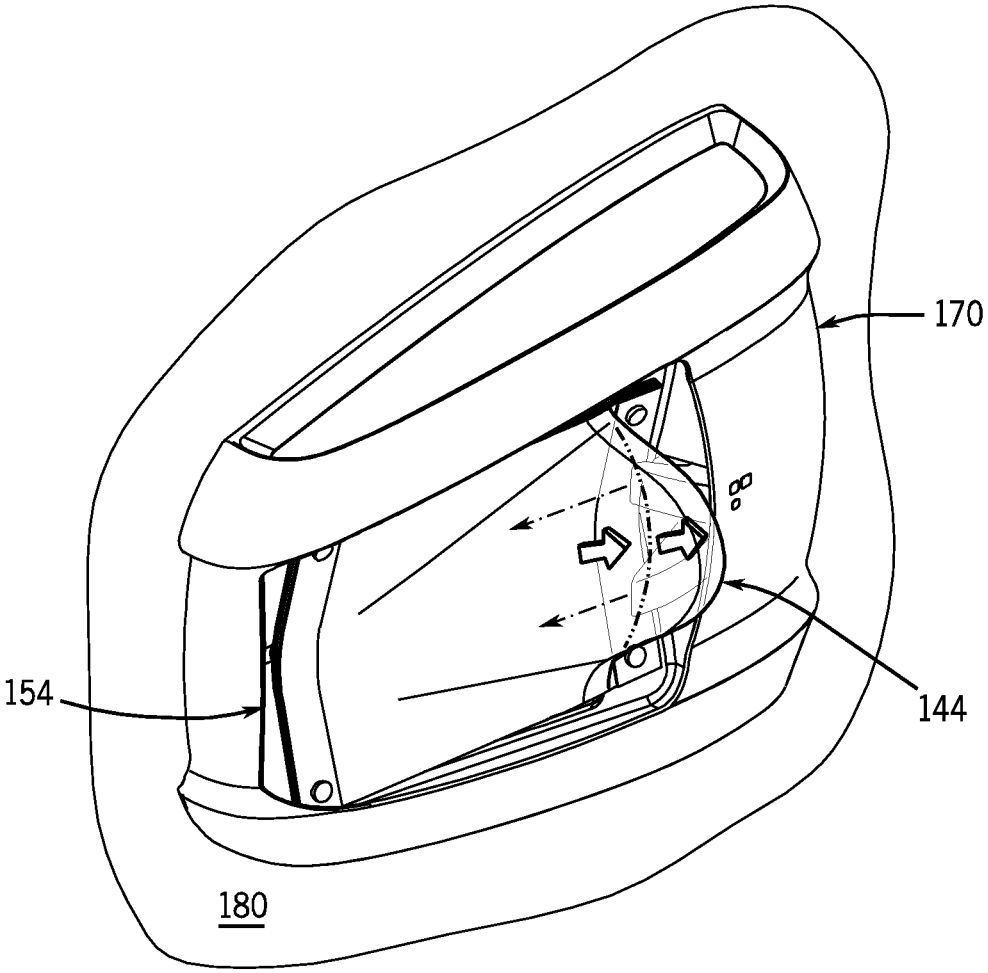
FIG. 14 is a plan view similar to the one illustrated in FIG. 13, showing the hand protection barrier dispenser opening the next hand protection barrier to prepare it for dispending.

In FIG. 14, the timed period operated by the electronic system contained in the system board 40 has expired, and the operation of the blower 54 will provide air through the air duct assembly 60 is shown to be in the process of opening the top hand protection barrier 144 in the stack 154 of hand protection barriers 144. Finally the hand protection barrier dispenser 170 will have returned to the position illustrated in FIG. 10, with the next hand protection barrier 144 being fully open and ready for dispensing to the next user.

Figure 15:
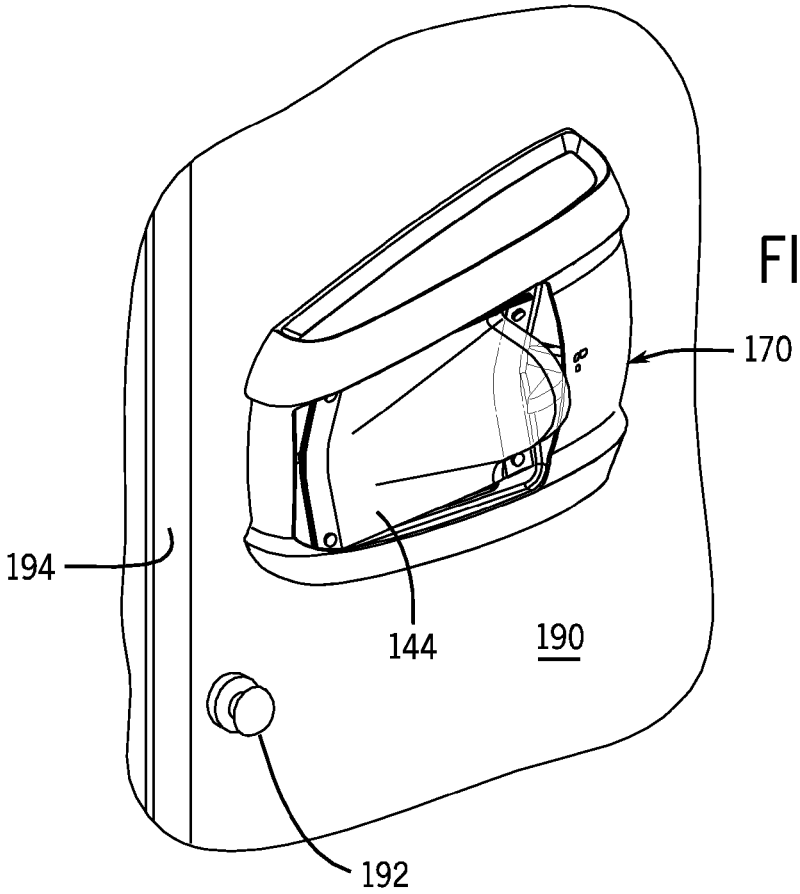
FIG. 15 is an isometric view showing the hand protection barrier dispenser containing the stack of hand protection barriers shown in FIG. 7 mounted on a restroom door near a restroom door handle.

Referring next to FIG. 15, the hand protection barrier dispenser 170 is illustrated as mounted on a restroom door 190 near a restroom door handle 192 of the restroom door 190. The restroom door 190 is mounted in a restroom door frame 194. A restroom user may dispense a hand protection barrier 144 from the hand protection barrier dispenser 170 onto the user's hand 182, and turn the restroom door handle 192 to open the restroom door 190 while using the hand protection barrier 144 to protect the user's hand 182 from bacterial potentially located on the restroom door handle 192.

Figure 16:
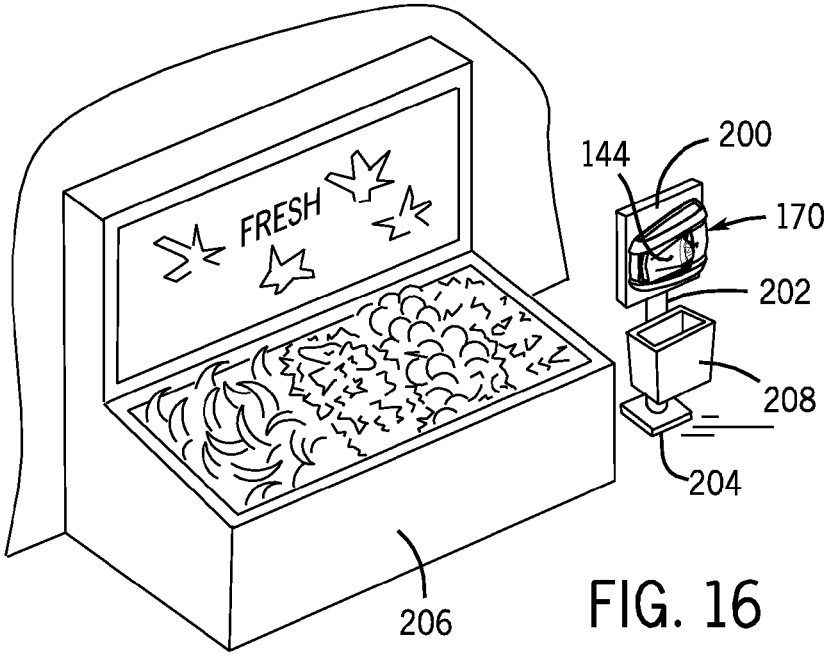
FIG. 16 is an isometric view showing the hand protection barrier dispenser containing the stack of hand protection barriers shown in FIG. 7 mounted at a location near a produce section of a grocery store.

Referring now to FIG. 16, the hand protection barrier dispenser 170 is illustrated as mounted on a dispenser support member 200 located at the top of dispenser support post 202 supported from a dispenser support base 204. Using the hand protection barrier dispenser 170, the hand protection barrier dispenser 170 may be located adjacent a produce section 206 in a grocery store. A shopper may dispense a hand protection barrier 144 from the hand protection barrier dispenser 170 onto the shopper's hand, after which the shopper may select product without potentially contaminating the produce handled or selected. After the customer is finished, the customer may dispose of the hand protection barrier 80 into a disposal bin 208. The hand protection barrier dispenser 170 may also find application in the bakery section or the meat department of a grocery store.

Figure 17:
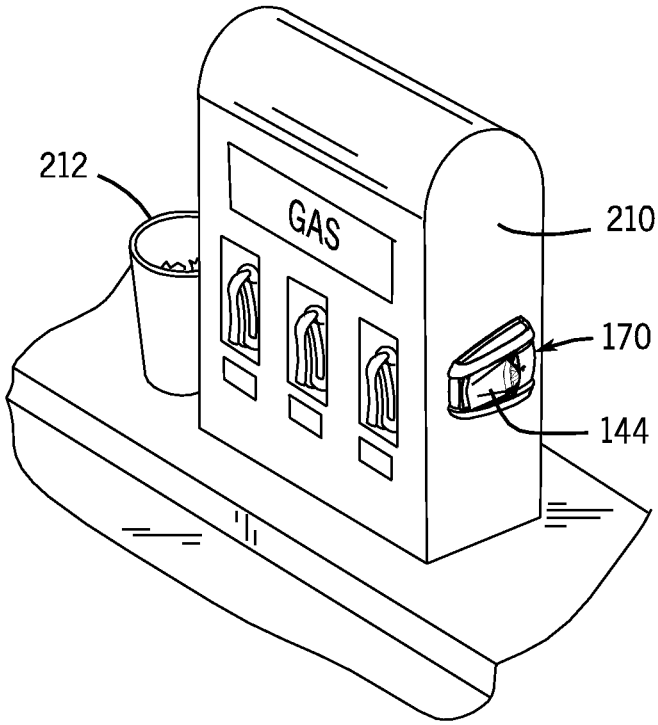
FIG. 17 is an isometric view showing the hand protection barrier dispenser containing the stack of hand protection barriers shown in FIG. 7 mounted on a gasoline pump at a service station.

Referring finally to FIG. 17, the hand protection barrier dispenser 170 is illustrated as mounted on the side of a gas pump 210. A customer may dispense a hand protection barrier 144 from the hand protection barrier dispenser 170 onto the customer's hand, after which the customer may pump gas from the gas pump 210. After the customer is finished, the customer may dispose of the hand protection barrier 144 into a disposal bin 212.

It may therefore be appreciated from the above detailed description of the exemplary embodiments of the present invention that it teaches a simple, inexpensive, and yet effective hand protection barrier dispenser for use by public restroom users and the like to dispense hand protection barriers. The hand protection barriers dispensed by the hand protection barrier dispenser provide a one hundred percent complete hand protection barrier for substantially the entire hand. The hand protection barrier dispenser for dispensing such hand protection barriers is also easy and intuitive to use, and it is reliably implemented.

The hand protection barrier dispenser of the present invention is of a construction which is both durable and long lasting, and which will require little or no maintenance to be provided by the user throughout its operating lifetime. The hand protection barrier dispenser of the present invention is also of inexpensive construction to enhance its market appeal and to thereby afford it the broadest possible market. Finally, all of the aforesaid advantages and objectives of the hand protection barrier dispenser of the present invention are achieved without incurring any substantial relative disadvantage.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Although the foregoing description of the hand protection barrier dispenser of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A hand protection barrier dispenser for dispensing hand protection barriers from a stack of such hand protection barriers each having an opening therein near a top end thereof, said hand protection barrier dispenser comprising:

a housing including a receptacle in which the stack of hand protection barriers may be installed for dispensing;

an electric blower located in the housing which electric blower has an exhaust opening from which the electric blower blows air when the electric blower is provided with electric power;

a switching mechanism which is located in the housing and is connected to a source of electric power, the switching mechanism being configured to provide electric power to the electric blower when the switching mechanism is actuated and to not provide electric power to the electric blower when the switching mechanism is not actuated;

at least one nozzle operatively connected to the exhaust opening of the electric blower to receive air blown from the electric blower when the switching mechanism is actuated and to direct the blown air toward the opening in a top one of the hand protection barriers in the stack of hand protection barriers in a manner that opens the top hand protection barrier to facilitate a user inserting the user's hand through the opening in the top hand protection barrier to don the top hand protection barrier; and an electronic system for operating the hand protection barrier dispenser to open the hand protection barrier, wherein the electronic system comprises:

an electronic system board;

one or more batteries located in the housing and electrically connected to the electronic system board; and a system sensor for detecting the proximity of a user's hand at a location adjacent to the opening of the top hand protection barrier in the stack of hand protection barriers;

wherein the top hand protection barrier donned by a user may be removed from the stack of hand protection barriers by pulling the top hand protection barrier in which the user's hand is located away from the remainder of the stack of hand protection barriers.

2. A hand protection barrier dispenser as defined in claim 1, wherein the receptacle has first and second sides and first and second ends and wherein the stack of hand protection barriers is installed in the receptacle with the top ends of the hand protection barriers located adjacent the first end of the receptacle.

3. A hand protection barrier dispenser as defined in claim 2, wherein the hand protection barriers are essentially rectangular and have corners adjacent to which apertures are located, the hand protection barriers in a stack being held together with a spool disposed in the apertures adjacent each corner of the hand protection barriers in the stack, each spool having an aperture extending therethrough, wherein the receptacle additionally comprises:

a dispenser mounting peg mounted adjacent to each of four corners in the receptacle each of which corners is defined between an intersection between one of the first and second sides and one of the first and second ends;

wherein the stack of hand protection barriers is installed by mounting the plurality of spools of the stack of hand protection barriers onto a corresponding one of the dispenser mounting pegs.

4. A hand protection barrier dispenser as defined in claim 3, wherein the stack of hand protection barriers additionally comprises a collar encasing the top ends of the hand protection barriers including two of the corners thereof, the spools adjacent these corners also extending through apertures located in the collar, and wherein the dispenser mounting pegs having the spools adjacent these corners also extend through apertures located in the collar mounted thereon being arranged and configured in the receptacle to maintain the collar and the top ends of the hand protection barriers in a position close adjacent the receptacle.

5. A hand protection barrier dispenser as defined in claim 2, wherein the receptacle is arranged and configured to have a V-shaped cross-section with the apex of the "V" extending in a direction essentially parallel to and midway between the first and second sides of the receptacle; and wherein when the stack of hand protection barriers is installed in the receptacle, the stack of hand protection barriers is also arranged and configured in a V-shaped cross-section with the apex of the "V" extending in a direction essentially parallel to and midway between the first and second sides of the hand protection barriers in the stack of hand protection barriers.

6. A hand protection barrier dispenser as defined in claim 5, wherein the receptacle comprises:

a rectangular elevated floor that extends intermediate the first and second sides of the receptacle, but which is spaced away from the first end of the receptacle in a manner arranged and configured to elevate the openings of the hand protection barriers in the stack of hand protection barriers above the top ends of the hand protection barriers to facilitate the ability of the blown air from the at least one nozzle to open the top one of the hand protection barriers in the stack of hand protection barriers.

7. A hand protection barrier dispenser as defined in claim 5, wherein the openings of the hand protection barriers in the stack of hand protection barriers each have a folded-over cuff that facilitates the top hand protection barrier in the stack of hand protection barriers remaining open once it has been opened.

8. A hand protection barrier dispenser as defined in claim 5, wherein the at least one nozzle is arranged in a position and configured to open the top hand protection barrier.

9. A hand protection barrier dispenser as defined in claim 2, wherein the at least one nozzle is mounted in the hand protection barrier dispenser in a position adjacent the first end of the receptacle.

10. A hand protection barrier dispenser as defined in claim 1, wherein substantially the entire receptacle is open on a top side to allow the stack of hand protection barriers to be visible when the stack of hand protection barriers is mounted in a position to be dispensed.

11. A hand protection barrier dispenser as defined in claim 1, wherein the at least one nozzle comprises:

a pair of nozzles, wherein the pair of nozzles are arranged and configured to open the top one of the hand protection barriers in the stack of hand protection barriers, and optionally to further maintain the top one of the hand protection barriers in the stack of hand protection barriers in an open position.

12. A hand protection barrier dispenser as defined in claim 11, wherein the switching mechanism is operated to supply electric power to operate the electric blower for a period of time that is sufficient to inflate the top hand protection barrier in the stack of hand protection barriers, wherein the time period is between about one second and about ten seconds.

13. A hand protection barrier dispenser as defined in claim 1, wherein the system sensor comprises:

a signal source for generating an optical or high frequency signal; and a signal sensor for detecting the reflected optical or high frequency signal if the optical or high frequency signal is reflected from a sufficiently close proximity to the system sensor.

14. A hand protection barrier dispenser as defined in claim 1, wherein the electronic system is arranged and configured to operate the hand protection barrier dispenser to open the hand protection barrier a predetermined time period after the detection by the system sensor of a user's hand at a location sufficiently proximal the opening of the top hand protection barrier in the stack of hand protection barriers;

wherein the predetermine time period is sufficiently long to allow the user's hand detected proximal the opening of the top hand protection barrier in the stack of hand protection barriers to engage and remove the top hand protection barrier from the stack of hand protection barriers such that the next hand protection barrier in the stack of hand protection barriers is opened subsequent to the removal of the top hand protection barrier.

15. A hand protection barrier dispenser as defined in claim 14, wherein the predetermined time period is between three and twenty seconds.

16. A hand protection barrier dispenser as defined in claim 1, wherein the electronic system is arranged and configured to operate the hand protection barrier dispenser to open the hand protection barrier upon the detection by the system sensor of a user's hand at a location sufficiently proximal the opening of the top hand protection barrier in the stack of hand protection barriers.

17. A hand protection barrier dispenser as defined in claim 1, additionally comprising:

an indicator LED visible from the exterior of the housing, wherein the electronic system is arranged and configured to count the number of detections by the system sensor of a user's hand at a location sufficiently proximal the opening of the top hand protection barrier in the stack of hand protection barriers and to display an alarm signal by flashing the indicator LED when the electronic system that only a predetermined number of the hand protection barriers remain in the stack of hand protection barriers.

18. A hand protection barrier dispenser for dispensing hand protection barriers from a stack of such hand protection barriers each having an opening therein near a top end thereof, said hand protection barrier dispenser comprising:

a housing including a receptacle in which the stack of hand protection barriers may be installed for dispensing;

an electric blower located in the housing which electric blower has an exhaust opening from which the electric blower blows air when the electric blower is provided with electric power;

wherein the electric blower comprises:

a DC brushless blower operable on electric power supplied by batteries and providing sufficient air to facilitate the opening of the top one of the hand protection barriers in the stack of hand protection barriers when the electric blower is operated;

a switching mechanism which is located in the housing and is connected to a source of electric power, the switching mechanism being configured to provide electric power to the electric blower when the switching mechanism is actuated and to not provide electric power to the electric blower when the switching mechanism is not actuated; and at least one nozzle operatively connected to the exhaust opening of the electric blower to receive air blown from the electric blower when the switching mechanism is actuated and to direct the blown air toward the opening in a top one of the hand protection barriers in the stack of hand protection barriers in a manner that opens the top hand protection barrier to facilitate a user inserting the user's hand through the opening in the top hand protection barrier to don the top hand protection barrier;

wherein the top hand protection barrier donned by a user may be removed from the stack of hand protection barriers by pulling the top hand protection barrier in which the user's hand is located away from the remainder of the stack of hand protection barriers.

19. A hand protection barrier dispenser as defined in claim 18, wherein at least one nozzle is mounted on the exhaust opening of the electric blower.

20. A hand protection barrier dispenser as defined in claim 18, additionally comprising:

an electronic system for operating the hand protection barrier dispenser to open the hand protection barrier, wherein the electronic system comprises:

an electronic system board;

one or more batteries located in the housing and electrically connected to the electronic system board;

a solenoid for operating the valve, the solenoid being electrically connected to the electronic system board; and a system sensor for detecting the proximity of a user's hand at a location adjacent to the opening of the top hand protection barrier in the stack of hand protection barriers.

21. A hand protection barrier dispenser as defined in claim 20, additionally comprising:

an indicator LED visible from the exterior of the housing, wherein the electronic system is arranged and configured to count the number of detections by the system sensor of a user's hand at a location sufficiently proximal the opening of the top hand protection barrier in the stack of hand protection barriers and to display an alarm signal by flashing the indicator LED when the electronic system that only a predetermined number of the hand protection barriers remain in the stack of hand protection barriers.

22. A hand protection barrier dispenser for dispensing hand protection barriers from a stack of such hand protection barriers each having an opening therein near a top end thereof, said hand protection barrier dispenser comprising:

a housing including a receptacle in which the stack of hand protection barriers may be installed for dispensing, wherein the receptacle has first and second sides and first and second ends and wherein the stack of hand protection barriers is installed in the receptacle with the top ends of the hand protection barriers located adjacent the first end of the receptacle, and wherein the receptacle is arranged and configured to have a V-shaped cross-section with the apex of the "V" extending in a direction essentially parallel to and midway between the first and second sides of the receptacle;

an electric blower located in the housing which electric blower has an exhaust opening from which the electric blower blows air when the electric blower is provided with electric power, wherein the electric blower comprises a DC brushless blower operable on electric power supplied by batteries and providing sufficient air to facilitate the opening of the top one of the hand protection barriers in the stack of hand protection barriers when the electric blower is operated;

a switching mechanism which is located in the housing and is connected to a source of electric power, the switching mechanism being configured to provide electric power to the electric blower when the switching mechanism is actuated and to not provide electric power to the electric blower when the switching mechanism is not actuated;

at least one nozzle operatively connected to the exhaust opening of the electric blower to receive air blown from the electric blower when the switching mechanism is actuated and to direct the blown air toward the opening in a top one of the hand protection barriers in the stack of hand protection barriers in a manner that opens the top hand protection barrier to facilitate a user inserting the user's hand through the opening in the top hand protection barrier to don the top hand protection barrier;

a system sensor for detecting the proximity of a user's hand at a location adjacent to the opening of the top hand protection barrier in the stack of hand protection barriers; and an electronic system for operating the switching mechanism in response to a signal from the system sensor to provide electric power to the electric blower to blow air to the at least one nozzle to open the hand protection barrier;

wherein the top hand protection barrier donned by a user may be removed from the stack of hand protection barriers by pulling the top hand protection barrier in which the user's hand is located away from the remainder of the stack of hand protection barriers.

23. A method of dispensing hand protection barriers from a stack of such hand protection barriers with a hand protection barrier dispenser, the hand protection barriers each having an opening therein near a top end thereof, said method comprising:

installing the stack of hand protection barriers in a receptacle in the hand protection barrier dispenser;

providing an electric blower located in the housing which has an exhaust opening from air is blown when the electric blower is provided with electric power;

controlling the operation of the electric blower to blow air with a switching mechanism, the switching mechanism providing electric power to the electric blower when the switching mechanism is actuated and not provide electric power to the electric blower when the switching mechanism is not actuated;

operating the hand protection barrier dispenser to open the hand protection barrier with an electronic system, wherein the electronic system comprises:

an electronic system board;

one or more batteries located in the housing and electrically connected to the electronic system board;

a solenoid for operating the valve, the solenoid being electrically connected to the electronic system board; and a system sensor for detecting the proximity of a user's hand at a location adjacent to the opening of the top hand protection barrier in the stack of hand protection barriers;

directing the air blown from the exhaust opening of the electric blower through at least one nozzle receiving air blown from the electric blower when the switching mechanism is actuated toward the opening in a top one of the hand protection barriers in the stack of hand protection barriers in a manner that opens the top hand protection barrier to facilitate a user inserting the user's hand through the opening in the top hand protection barrier to don the top hand protection barrier; and pulling the top hand protection barrier in which the user's hand is located away from the remainder of the stack of hand protection barriers to remove the hand protection barrier donned by the user from the stack of hand protection barriers.

* * * * *